US009777898B1

(12) United States Patent
Landry et al.

(10) Patent No.: US 9,777,898 B1
(45) Date of Patent: Oct. 3, 2017

(54) MOLDING WITH EMBEDDED ILLUMINATION SOURCES

(71) Applicants: Shawn C. Landry, Fort Saskatchewan (CA); Amanda J. Davidson, Fort Saskatchewan (CA)

(72) Inventors: Shawn C. Landry, Fort Saskatchewan (CA); Amanda J. Davidson, Fort Saskatchewan (CA)

( * ) Notice: Subject to any disclaimer, the term of this patent is extended or adjusted under 35 U.S.C. 154(b) by 120 days.

(21) Appl. No.: 14/818,680

(22) Filed: Aug. 5, 2015

Related U.S. Application Data

(60) Provisional application No. 62/033,855, filed on Aug. 6, 2014.

(51) Int. Cl.

| | |
|---|---|
| ***F21V 21/30*** | (2006.01) |
| ***F21S 8/04*** | (2006.01) |
| ***F21V 23/02*** | (2006.01) |
| ***F21V 23/00*** | (2015.01) |
| ***F21V 19/02*** | (2006.01) |
| *F21W 131/107* | (2006.01) |

(52) U.S. Cl.
CPC ..... *F21S 8/046* (2013.01); *F21V 19/02* (2013.01); *F21V 21/30* (2013.01); *F21V 23/002* (2013.01); *F21V 23/02* (2013.01); *F21W 2131/107* (2013.01)

(58) Field of Classification Search
CPC ..... F21S 8/046; F21V 19/02; F21V 21/30; F21V 23/002; F21V 23/02; F21V 14/00; F21V 15/01; F21V 15/015; F21V 17/02; F21V 17/06; F21V 17/107; F21V 17/12; F21V 19/00; F21V 21/00; F21V 21/02; F21V 21/005; F21V 21/14; F21W 2131/107
See application file for complete search history.

(56) References Cited

U.S. PATENT DOCUMENTS

| | | | | |
|---|---|---|---|---|
| 3,692,993 | A | 9/1972 | Robinson | |
| 5,510,966 | A * | 4/1996 | Konecny ..... | F21S 8/028 362/145 |
| 5,813,751 | A | 9/1998 | Shaffer | |
| 5,823,655 | A | 10/1998 | Brooks | |
| 6,050,709 | A | 4/2000 | Hastings | |
| 6,224,232 | B1 | 5/2001 | Rodriguez | |
| 6,363,662 | B1 | 4/2002 | Coates | |
| 6,364,508 | B1 | 4/2002 | Moreland | |
| 6,474,840 | B2 | 11/2002 | Padermos | |

(Continued)

*Primary Examiner* — Bao Q Truong
(74) *Attorney, Agent, or Firm* — Robert C. Montgomery; Montgomery Patent & Design LP

(57) ABSTRACT

An exterior molding system adapted to provide decoratively illuminated lighting for a building and which incorporates first and second lighting panels each having a plurality of illuminating devices. The lighting panels are attachable to a soffit that is itself attached to a building. The second light panel is hinged to the first light panel so as to enable the second light panel to be deployed either opened or folded up under the first light panel. The second light panel includes illuminating devices that are visible when the second light panel is opened and that are hidden when the second light panel is folded under the first light panel. A remote control panel is in electrical communication with the illuminating devices. The control panel receives electrical power and selectively powers at least one (1) illuminating device.

16 Claims, 5 Drawing Sheets

(56) References Cited

U.S. PATENT DOCUMENTS

| | | | | |
|---|---|---|---|---|
| 6,572,239 | B1 | 6/2003 | Harbin | |
| 6,846,092 | B2 | 1/2005 | Taylor et al. | |
| 6,918,680 | B2 * | 7/2005 | Seeberger | E04D 13/158 362/147 |
| 6,955,458 | B2 | 10/2005 | Cheema | |
| 7,059,749 | B1 | 6/2006 | Bernier | |
| 7,244,039 | B1 | 7/2007 | Emmons et al. | |
| 7,306,354 | B2 | 12/2007 | Haas | |
| 7,658,518 | B2 | 2/2010 | Shwisha | |
| 7,845,819 | B1 | 12/2010 | Strong | |
| 7,950,828 | B2 * | 5/2011 | Zhang | F21K 9/00 362/231 |
| 8,317,353 | B1 | 11/2012 | Martin | |
| 9,033,547 | B2 * | 5/2015 | Manahan | F21V 21/14 362/233 |
| 9,205,774 | B2 * | 12/2015 | Kennemer | F21L 14/00 |
| 2005/0225982 | A1 | 10/2005 | Hahn | |
| 2010/0110668 | A1 | 5/2010 | Marlonia | |

* cited by examiner

MOLDING WITH EMBEDDED ILLUMINATION SOURCES

RELATED APPLICATIONS

This application claims the benefit of U.S. Provisional Application No. 62/033,855, which was filed Aug. 6, 2014, the entire disclosures of which are incorporated herein by reference.

FIELD OF THE INVENTION

The present invention relates generally to building illumination. More particularly it relates to a selectively deployable exterior molding system having decorative illumination.

BACKGROUND OF THE INVENTION

Americans traditionally celebrate some holidays such as Christmas, New Years, President's Day, Halloween, and the Fourth of July by displaying holiday decorations. Holiday decorative items easily comprise a multimillion dollar a year and growing industry.

Among the favorite and most popular of all specialty decorations is outdoor lighting. Outdoor decorative lighting can be used to adorn things such as trees, bushes, roof lines, overhangs, and the like to provide an eye appealing and highly festive decoration.

While outdoor decorative lighting on buildings is very popular their use does take a relatively long time and significant effort to set up, to take down and then to store away for next year. Consequently many outdoor building decorative lighting displays are left up for months after the holiday. In addition to the time and effort to put up, take down and store building decorative lighting their use often requires the use of ladders. Ladders present serious safety issues, especially when used by people who do not use ladders often and/or when used in inclement weather.

Accordingly, there exists a need for decorative exterior lighting on buildings that can be used and enjoyed without the disadvantages of excess time, effort and danger.

SUMMARY OF THE INVENTION

The principles of the present invention provide for exterior decorative lighting that can be safely used without ladders and which requires little time and effort to use.

In one (1) embodiment the present invention is an illuminated molding system for mounting to a building exterior. The molding system includes a soffit and a first light panel affixed and suspended from that soffit. The first light panel having a first plurality of illuminating devices. Also included is a second light panel that is hinged to the first light panel so as to enable the second light panel to be deployed either opened or folded up under the first light panel. The second light panel includes a second plurality of illuminating devices that are visible when the second light panel is opened and that are hidden when the second light panel is folded up. Also included is a control panel that is remotely located from the soffit and in electrical communication with the first and second plurality of illuminating devices. The control panel is for receiving electrical power and for selectively powering at least one (1) illuminating device of the first and second plurality of illuminating devices.

That illuminated molding system can beneficially have the first plurality of illuminating devices implemented as a plurality of embedded sockets that are disposed about the first panel and a plurality of illuminating lamps retained in the plurality of embedded sockets. The control panel should be capable of selectively energizing a pattern of the first and second plurality of illuminating devices. In addition, a first fastener is preferably included for retaining the second light panel opened and a second fastener can be included for retaining the second light panel folded up under the first light panel. At least the second fastener may be a thumb screw and can mate with a second fastener. In use the soffit is attached at one (1) side to a ledger strip and at the other side to a fascia board. Electrical communication with the first and second plurality of illuminating devices is provided by electrical wiring, which may pass through a protective boot.

In another embodiment the invention is an illuminated molding system for mounting to a building exterior having an existing soffit. That illuminated molding system then comprises a first light panel for being affixed to and suspended from the building soffit, the first light panel having a first plurality of illuminating devices. Also included is a second light panel hinged to the first light panel so as to enable the second light panel to be deployed either opened or folded up under the first light panel. The second light panel then having a second plurality of illuminating devices that are visible when the second light panel is opened and that are hidden when the second light panel is folded up. Also included is a control panel for being remotely located from and in electrical communication with the first and second plurality of illuminating devices. That control panel is for receiving electrical power and for selectively powering at least one (1) illuminating device of the first and second plurality of illuminating devices.

That embodiment illuminated molding system can beneficially have the first plurality of illuminating devices implemented as a plurality of embedded sockets that are disposed about the first panel and a plurality of illuminating lamps retained in the plurality of embedded sockets. The control panel should be capable of selectively energizing a pattern of the first and second plurality of illuminating devices. In addition, a first fastener is preferably included for retaining the second light panel opened and a second fastener can be included for retaining the second light panel folded up under the first light panel. At least the second fastener may be a thumb screw and can mate with a second fastener. Electrical communication with the first and second plurality of illuminating devices is provided by electrical wiring, which may pass through a protective boot made of rubber.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

DESCRIPTIVE KEY

Figure 1:
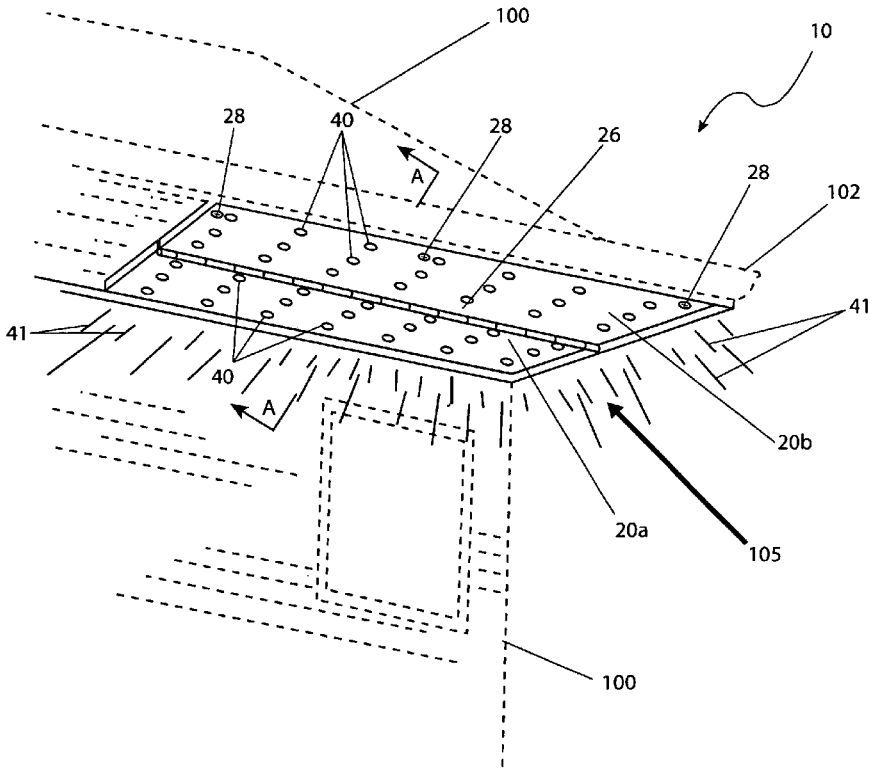
FIG. 1 is an environmental view of a soffit lighting system 10 according to a preferred embodiment of the present invention.

10 soffit lighting system
20*a* first light panel
20*b* second light panel
22 soffit panel
24 recessed area
26 hinge
28 quick-connect fastener
30 fastener insert
40 light
41 illumination
42 wiring
43 socket
44 rubber boot
50 control panel
52 electrical enclosure
54 row switch
56 main switch
80 fastener
100 building
102 gutter
103 wall structure
104 ledger strip
105 eave
106 fascia board

DETAILED DESCRIPTION OF THE PREFERRED EMBODIMENT

The preferred embodiment of the present invention is depicted within FIGS. 1-5. However, the invention is not limited to what is specifically illustrated and described. A person skilled in the art will appreciate that many other embodiments of the invention are possible without deviating from the basic concept of the invention. Any such work around also falls with the scope of this invention.

The terms "a" and "an" herein do not denote a limitation of quantity, but rather denote the presence of at least one of the referenced items. In addition, unless otherwise denoted all directional signals such as up, down, left, right, inside, outside are taken relative to the illustration shown in FIG. 1.

Referring now to FIG. 1, the present invention describes a foldable soffit lighting system 10 for homes and buildings 100 and which includes integrated holiday lights 40. The soffit lighting system 10 implements a hinged system for discreetly contain the lights 40 when the lights 40 are not going to be used. The soffit lighting system 10 thus avoids problems with the annual installation and removal of holiday decorative lighting displays.

The soffit lighting system 10 includes a first light panel 20*a* mounted to an eave 105 of the building 100. The soffit lighting system 10 further includes a second light panel 20*b* that is attached to the first light panel 20*a* by a hinge 26. Each light panel 20*a*, 20*b* includes rows of recessed lights 40 (also see FIGS. 2*a*, 3, and 5). The light panels 20*a*, 20*b* are envisioned as being introduced in a variety of colors and in various standard lengths such as six or eight feet (6-8 ft.). The light panels 20*a*, 20*b* are preferably made of a plastic material such as vinyl, but other materials such as another plastic, wood, aluminum, steel or another metal can also be used.

Figure 2A:
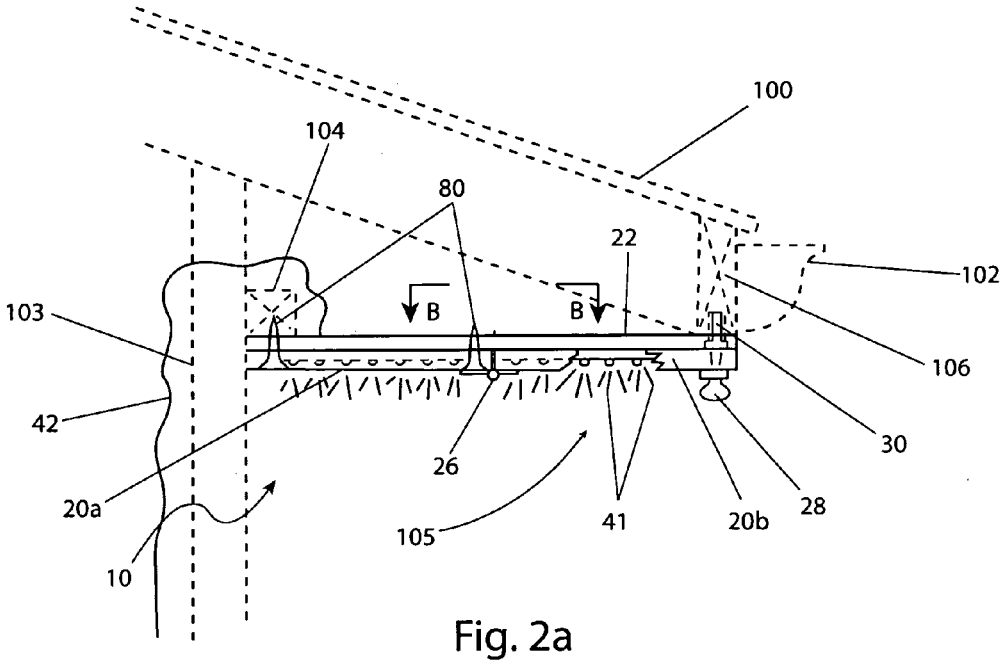
FIG. 2*a* is a sectional view of the soffit lighting system 10 of FIG. 1 taken along section line A-A (see FIG. 1) when deployed.
Figure 2B:
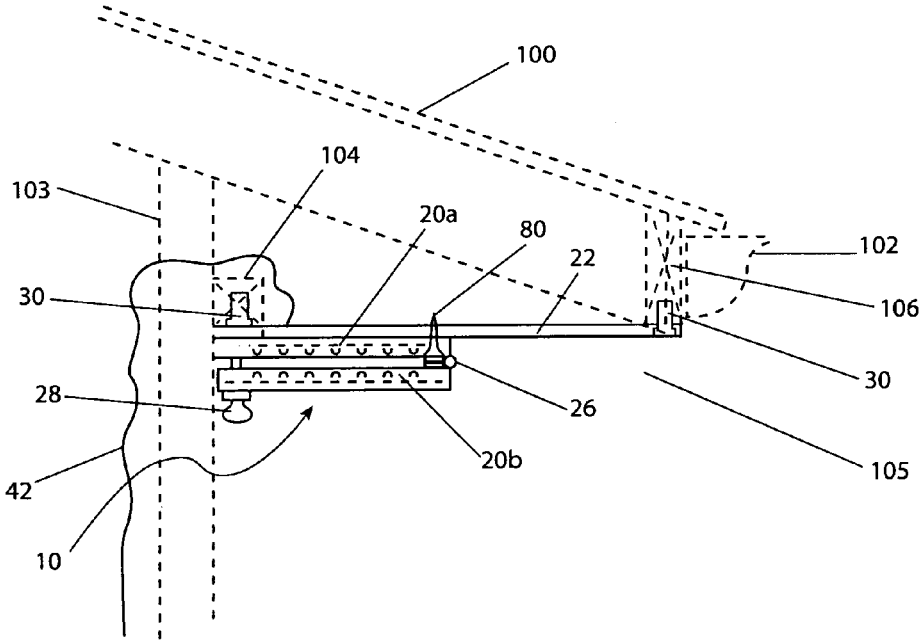
FIG. 2*b* is another sectional view of the soffit lighting system 10 shown in FIG. 1, but now shown folded.

Refer now to FIGS. 2*a* and 2*b* for sectional views of the soffit lighting system 10 when deployed (FIG. 2*a*) and when folded (FIG. 2*b*). The soffit lighting system 10 may be installed as a replacement soffit for a building 100 or used in new construction. The light panels 20*a*, 20*b* are preferably attached to a soffit panel 22 (shown in FIGS. 2*a* and 2*b*) or they may be added to an existing soffit of the building 100.

One (1) edge of the soffit panel 22 is beneficially attached to a ledger strip 104 of a wall structure 103. The other edge of the soffit panel 22 is beneficially attached to the bottom of a fascia board 106 (shown supporting a gutter 102). The first light panel 20*a* is then affixed and suspended from the soffit panel 22 adjacent to the wall structure 103 using a plurality of fasteners 80 such as screws. The second light panel 20*b* can then pivot on the hinge 26. The hinge 26 enables the second light panel 20*b* to be deployed either open such that the lights 40 are visible (shown in FIG. 2*a*) or folded up under the first light panel 20*a* (shown in FIG. 2*b*). When folded under the first light panel 20*a* the lights 40 are hidden.

Still referring to FIGS. 2*a* and 2*b*, the second light panel 20*b* is retained in either its deployed or folded position using quick-connect fasteners 28. The quick-connect fasteners 28 are preferably thumb screws to provide not only strength but quick attachment and detachment so as to minimize the time required to deploy or conceal the light 40. The quick-connect fasteners 28 are envisioned to work in conjunction with correspondingly positioned and mating fastener inserts 30 that are installed "flush" with the bottom of the ledger strip 104 and the fascia board 106 of the building 100.

Figure 3:
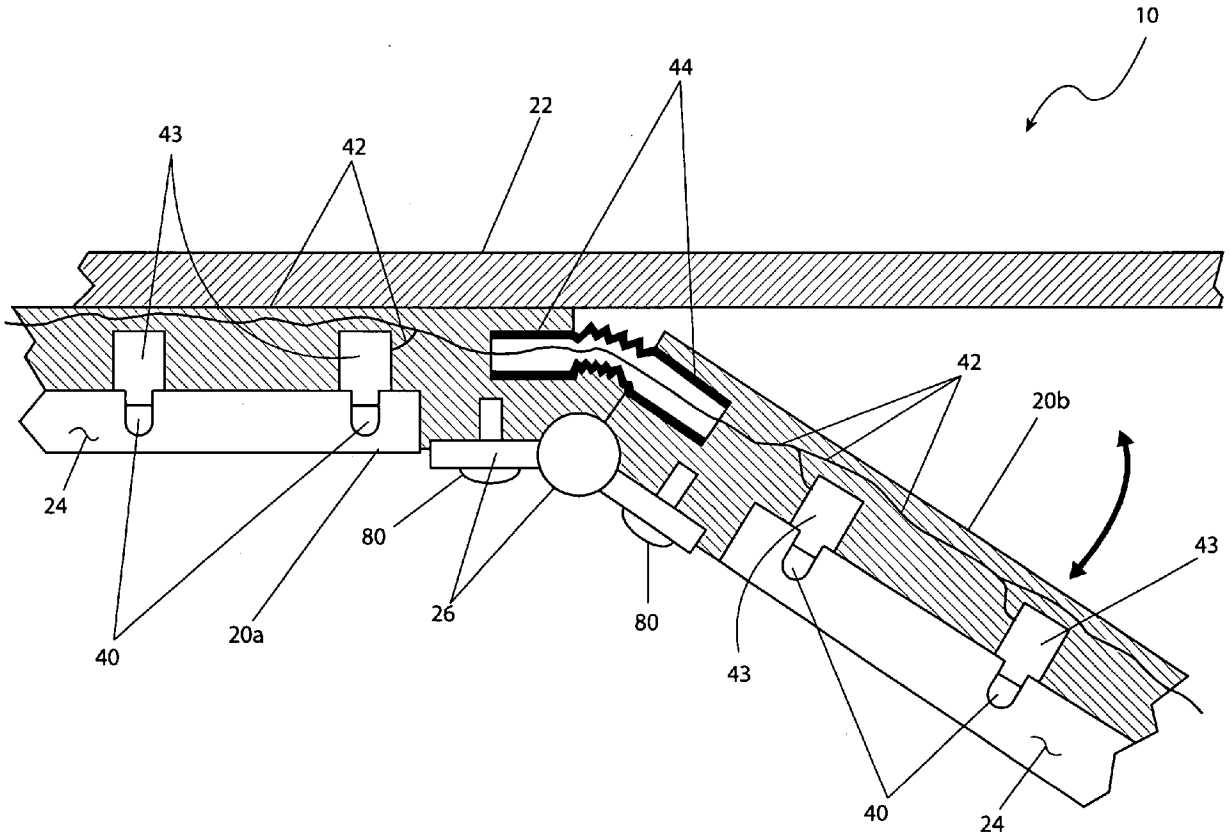
FIG. 3 is a sectional view of light panels 20*a*, 20*b* and their adjoining hinge 26 used in the soffit lighting system 10 of FIG. 1 and taken along section line B-B (see FIG. 2*a*)

Refer now to FIG. 3 for a sectional view of the light panels 20, 20*b* and the hinge 26 taken along section line B-B (see FIG. 2*a*) when the light panel 20*b* is partially pivoted on the hinge 26. The lights 40 are preferably miniature illuminating devices such as incandescent bulbs, light-emitting diodes (LEDs), or another lamp type. The lights 40 are installed within embedded sockets 43 that are mounted in recessed areas 24 of each light panel 20*a*, 20*b*. The sockets 43 provide plug-in, screw-in, or another removable attachment to provide easy replacement of the lights 40 as needed.

The soffit lighting system 10 preferably is electrically wired using a discreet wiring arrangement with interconnecting wiring 42 that runs internal to the light panels 20*a*, 20*b* and thus is hidden from view. The wiring 42 can be hidden by integral molding or wire routing within grooves such as along rear surfaces which can then be sealed using a color-matching caulk. Other wiring techniques which result in hidden wiring can also be used. A particular embodiment of the soffit lighting system 10, shown in FIG. 3, has a rubber boot 44 which provides a flexible conduit for wiring 42 running between the first light panel 20*a* and the second light panels 20*b*. The rubber boot 44 provides environmental as well as physical damage protection for the wiring 42. The wiring 42 is envisioned as exiting the first light panel 20*a* and discreetly routed through the eave 105 to terminate at a control panel 50 which is beneficially located within the building 100 (reference FIGS. 4 and 5).

Figure 4:
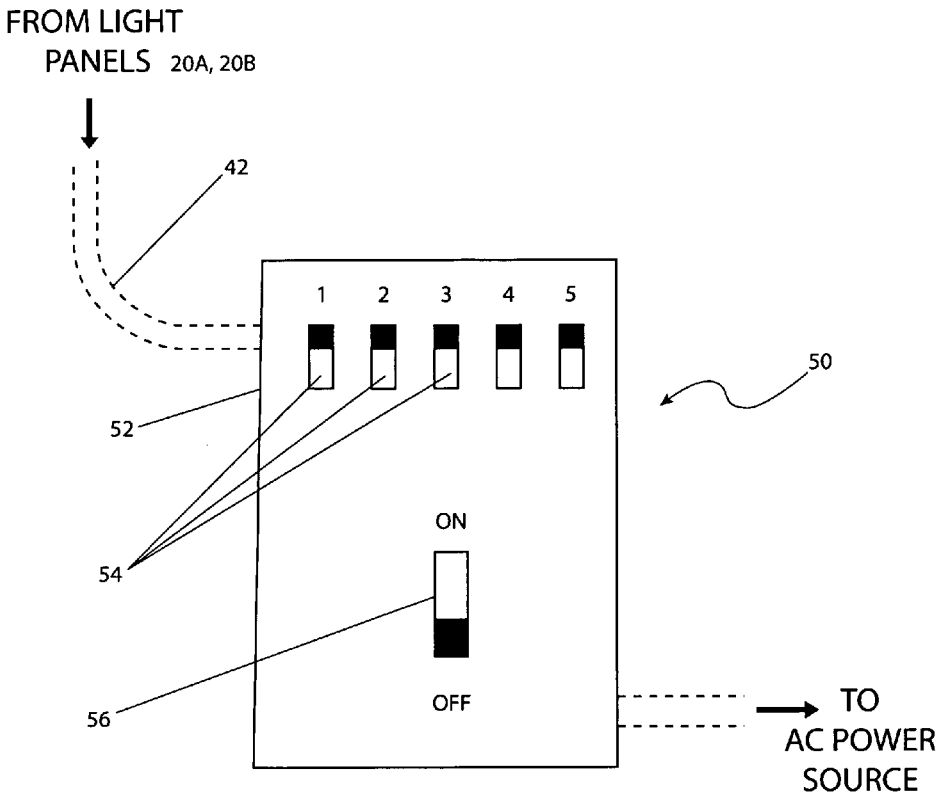
FIG. 4 is a front view of a control panel 50 of the soffit lighting system 10 shown in FIG. 1; and, FIG. 5 is an electrical block diagram of the soffit lighting system 10 of FIG. 1.
Figure 5:
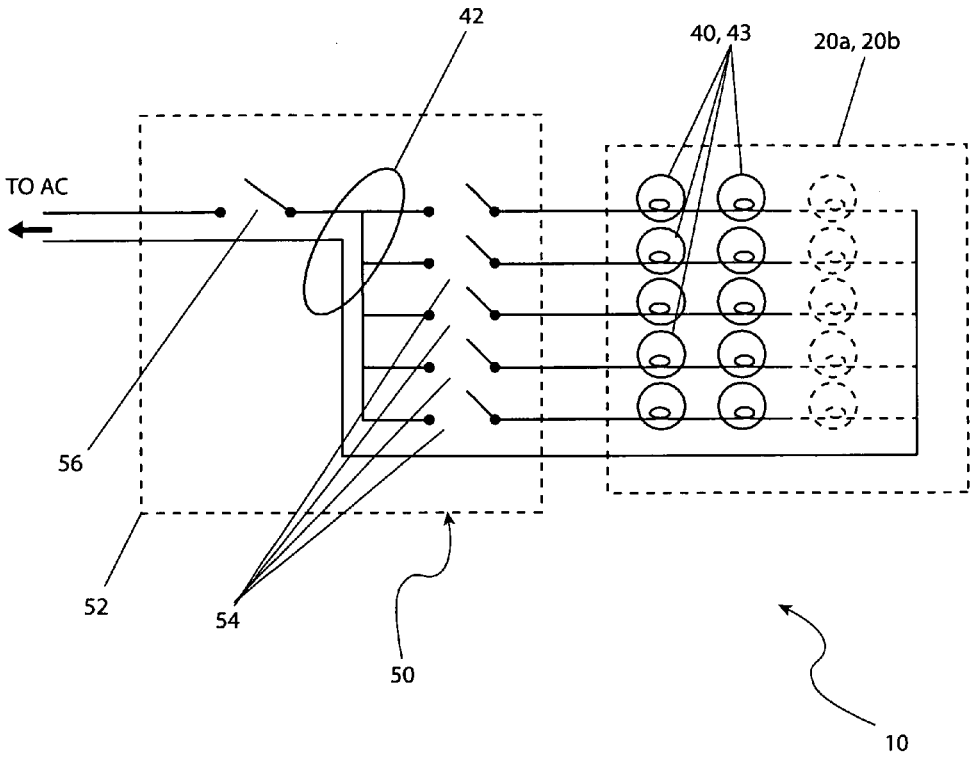

FIGS. 4 and 5 respectively present a front view of the control panel 50 and an electrical block diagram of the soffit lighting system 10. Wiring 42 from the light panels 20*a*, 20*b* is bundled according to rows of lights 40, routed through the building 100, and connected to corresponding row switches 54 located on the control panel 50. This enables a user to selectively energize particular rows or a selected number of rows of lights 40.

The control panel 50 is preferably installed in a convenient location within the building 100. Ideally it should have a similar appearance as a conventional wall-mounted light switch. The control panel 50 includes a rectangular electrical enclosure 52 having a main switch 56 as well as the row switches 54. All switches 54, 56 are preferably arranged along the front of the electrical enclosure 52. The main switch 56 energizes the soffit lighting system 10 by selectively providing power from an AC power source to the row switches 54. The row switches 54 in turn selectively provide power to specific rows of lights 40.

It is envisioned that other styles and configurations of the present invention can be easily incorporated into the teachings of the present invention. While only one particular configuration is shown and described that is for purposes of clarity and disclosure and not by way of limitation of scope.

The preferred embodiment of the present invention can be used by a common user in a simple and effortless manner with little or no training. After initial purchase or acquisition of the soffit lighting system 10 it would be installed as indicated in FIGS. 1, 2*a*, and 2*b*.

The method of installing and utilizing the soffit lighting system 10 may be achieved by: procuring a required number of soffit lighting systems 10 to complete an installation project on the building 100 with each soffit lighting system 10 having the desired color, length, and width; installing the control panel 50 at a convenient location within the building 100; connecting existing AC power to the main switch 56 of control panel 50; routing wiring 42 between the light panel 20*a*, 20*b* and the control panel 50 in a discreet manner within eave 105 and wall structure 103 of the building 100 in accordance with all federal, state and local electrical codes; installing fastener inserts 30 into the ledger strip 104 and he fascia board 106 of the eave 105 with the fastener inserts 30 in proper position to mate with the quick-connect fastener 28 of the second light panels 20*b*; attaching the soffit panel 22 to the ledger strip 104 and fascia board 106 using fasteners 80; attaching the first light panel 20*a* to a the soffit panel 22 and adjacent to the wall structure 103, while giving care to the alignment of respective fastener inserts 30 and quick-connect fasteners 28; positioning the second light panel 20*b* in an outwardly extending and coplanar manner so as to expose the lights 40; securing the second light panel 20*b* to the fascia board 106 by inserting the quick-connect fasteners 28 through the second light panel 20*b* and into corresponding fastener inserts 30; installing the lights 40 into sockets 43, if not previously installed; repeating the previous steps for any additional units of the soffit lighting system 10 in a longitudinal end-to-end manner along the eaves 105 until completion of the project; preparing the soffit lighting system 10 to display a decorative theme by setting the row switches 54 of the control panel 50 to energize particular rows of lights 40, or selecting any desired row or rows of the lights 40, as desired; activating the lights 40 at such time as illumination 41 is desired, by using the main switch 56 of the control panel 50; and, benefiting from decorative illumination 41 of eave 105 of a building 100 in an attractive and discrete manner afforded a user of the soffit lighting system 10.

When illumination 41 from the soffit lighting system 10 is not desired the second light panel 20*b* may be folded against the first light panel 20*a* and secured in position using the quick-connect fasteners 28 so as to discretely contain and hide the lights 40.

The low-profile of the soffit lighting system 10 and the use of internal wiring 42 results in the lights 40 being unobvious, thereby allowing a user to leave the lights 40 up year round if desired. It is envisioned that the soffit lighting system 10 would be installed during initial construction of a building structure 100 or as part of a renovation project.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. An illuminated molding system for mounting to a building exterior, comprising:

a soffit;

a first light panel affixed and suspended from said soffit, said first light panel having a first plurality of illuminating devices;

a second light panel hinged to said first light panel so as to enable said second light panel to be deployed either opened or folded up under said first light panel; said second light panel having a second plurality of illuminating devices that are visible when said second light panel is opened and hidden when said second light panel is folded up;

a first fastener for retaining said second light panel open;

a second fastener for retaining said second light panel folded up under said first light panel; and, a control panel remotely located from said soffit and in electrical communication with said first and second plurality of illuminating devices, said control panel for receiving electrical power and for selectively powering at least one illuminating device of said first and second plurality of illuminating devices.

2. The illuminated molding system of claim 1, wherein said first plurality of illuminating devices comprises a plurality of embedded sockets disposed about said first panel and a plurality of illuminating lamps retained in said plurality of embedded sockets.

3. The illuminated molding system of claim 1, wherein said control panel is capable of selectively energizing a pattern of said first and second plurality of illuminating devices.

4. The illuminated molding system of claim 1, wherein said second fastener is a thumb screw.

5. The illuminated molding system of claim 4, further including a fastener insert for mating with said second fastener.

6. The illuminated molding system of claim 1, wherein said soffit is attached at one side to a ledger strip and at the other side to a fascia board.

7. The illuminated molding system of claim 1, wherein electrical communication with said first and second plurality of illuminating devices is provided by electrical wiring.

8. The illuminated molding system of claim 7, wherein electrical wiring between said first and second plurality of illuminating devices passes through a protective boot.

9. An illuminated molding system for mounting to a building exterior, comprising:

a first light panel for being affixed to and suspended from a building soffit, said first light panel having a first plurality of illuminating devices;

a second light panel hinged to said first light panel so as to enable said second light panel to be deployed either opened or folded up under said first light panel; said second light panel having a second plurality of illuminating devices that are visible when said second light panel is opened and hidden when said second light panel is folded up;

a first fastener for retaining said second light panel open;

a second fastener for retaining said second light panel folded up under said first light panel; and, a control panel remotely located from and in electrical communication with said first and second plurality of illuminating devices, said control panel for receiving electrical power and for selectively powering at least one illuminating device of said first and second plurality of illuminating devices.

10. The illuminated molding system of claim 9, wherein said first plurality of illuminating devices comprises a plurality of embedded sockets disposed about said first panel and a plurality of illuminating lamps retained in said plurality of embedded sockets.

11. The illuminated molding system of claim 9, wherein said control panel is configured to selectively energizing a pattern of said first and second plurality of illuminating devices.

12. The illuminated molding system of claim 9, wherein said second fastener is a thumb screw.

13. The illuminated molding system of claim 12, further including a fastener insert for mating with said second fastener.

14. The illuminated molding system of claim 9, wherein electrical communication with said first and second plurality of illuminating devices is provided by electrical wiring.

15. The illuminated molding system of claim 14, wherein electrical wiring between said first and second plurality of illuminating devices passes through a protective boot.

16. The illuminated molding system of claim 15, wherein said boot is comprised of rubber.

* * * * *